US010858085B2

(12) United States Patent
Mech et al.

(10) Patent No.: US 10,858,085 B2
(45) Date of Patent: Dec. 8, 2020

(54) HANDLE WITH PADDLE CLIP

(71) Applicant: The Coleman Company, Inc., Wichita, KS (US)

(72) Inventors: Patrick Ryan Mech, Denver, CO (US); Cynthia Willey, Superior, CO (US); Darin Webb, Denver, CO (US)

(73) Assignee: The Coleman Company, Inc., Wichita, KS (US)

( * ) Notice: Subject to any disclaimer, the term of this patent is extended or adjusted under 35 U.S.C. 154(b) by 8 days.

(21) Appl. No.: 15/738,264

(22) PCT Filed: Jun. 22, 2016

(86) PCT No.: PCT/US2016/038741
§ 371 (c)(1),
(2) Date: Dec. 20, 2017

(87) PCT Pub. No.: WO2016/209944
PCT Pub. Date: Dec. 29, 2016

(65) Prior Publication Data

US 2018/0186440 A1 Jul. 5, 2018

Related U.S. Application Data

(60) Provisional application No. 62/182,848, filed on Jun. 22, 2015.

(51) Int. Cl.

| | |
|---|---|
| ***B63H 16/073*** | (2006.01) |
| ***A45F 5/10*** | (2006.01) |
| *B63H 16/04* | (2006.01) |
| *B63B 34/26* | (2020.01) |

(52) U.S. Cl.
CPC ..... *B63H 16/073* (2013.01); *A45F 5/10* (2013.01); *A45F 2005/1006* (2013.01); *A45F 2200/0566* (2013.01); *B63B 34/26* (2020.02); *B63H 16/04* (2013.01)

(58) Field of Classification Search
CPC ..... B63H 16/073; B63H 16/04; A45F 5/10; A45F 2005/1006; A45F 2200/0566; B63B 2035/715
USPC ..... 224/406
See application file for complete search history.

(56) References Cited

U.S. PATENT DOCUMENTS

| | | | | |
|---|---|---|---|---|
| 785,377 A | | 3/1905 | Poppert | |
| 1,840,210 A | | 1/1932 | Reekers | |
| 4,236,267 A | | 12/1980 | Lewis et al. | |
| 4,352,337 A | * | 10/1982 | Wyoral | B63B 35/7946 114/343 |
| 4,453,490 A | * | 6/1984 | Miller | B63H 16/04 114/364 |
| 4,701,142 A | * | 10/1987 | Merritt | B63H 16/04 16/426 |
| 5,421,283 A | | 6/1995 | Bruggemann et al. | |

(Continued)

FOREIGN PATENT DOCUMENTS

CA 57827 10/1897

*Primary Examiner* — Peter N Helvey
(74) *Attorney, Agent, or Firm* — Husch Blackwell LLP

(57) ABSTRACT

A handle for carrying watercraft, wherein the handle also functions to securely retain a paddle or oar, the handle comprising a channel for receiving and retaining a paddle or oar using an interference fit. The handle is secured to the watercraft by a strap attached to the watercraft body and passing through a slot in the handle that runs parallel to the channel.

5 Claims, 3 Drawing Sheets

(56) References Cited

U.S. PATENT DOCUMENTS

| | | | | |
|---|---|---|---|---|
| 5,564,357 | A | 10/1996 | Peterson | |
| 6,027,387 | A * | 2/2000 | Allin | B63B 17/00 114/364 |
| 6,632,111 | B2 * | 10/2003 | Oathout | B63H 16/06 114/364 |
| 6,863,014 | B2 | 3/2005 | Hudson et al. | |
| 7,527,012 | B2 * | 5/2009 | Kutny Splaine | B63B 25/002 114/343 |
| D626,285 | S | 10/2010 | Adame | |
| 8,894,456 | B2 * | 11/2014 | Bicknell | B25G 1/06 416/74 |
| 8,915,207 | B2 * | 12/2014 | Wirsig | B63B 39/00 114/364 |
| 9,499,235 | B1 * | 11/2016 | Blavat | B63B 17/00 |
| D785,540 | S * | 5/2017 | Olliges | D12/317 |
| 9,663,206 | B2 * | 5/2017 | Lee | B63H 16/04 |
| 9,663,208 | B1 * | 5/2017 | Blavat | B63H 16/06 |
| 2004/0103838 | A1 * | 6/2004 | Bolebruch | B63B 25/002 114/347 |
| 2011/0155040 | A1 | 6/2011 | Czipri | |
| 2014/0312191 | A1 * | 10/2014 | Reed | B63H 16/04 248/316.8 |
| 2016/0025264 | A1 * | 1/2016 | Casagrande | F16M 11/14 248/205.9 |

* cited by examiner

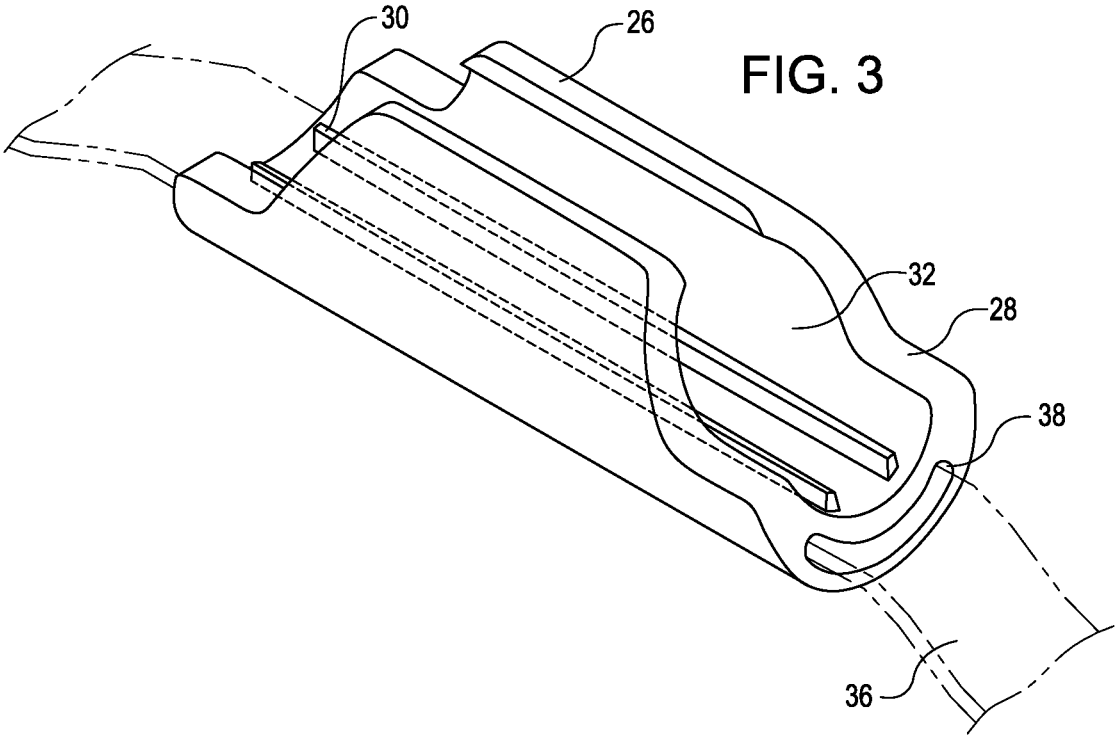
FIG. 3
FIG. 4
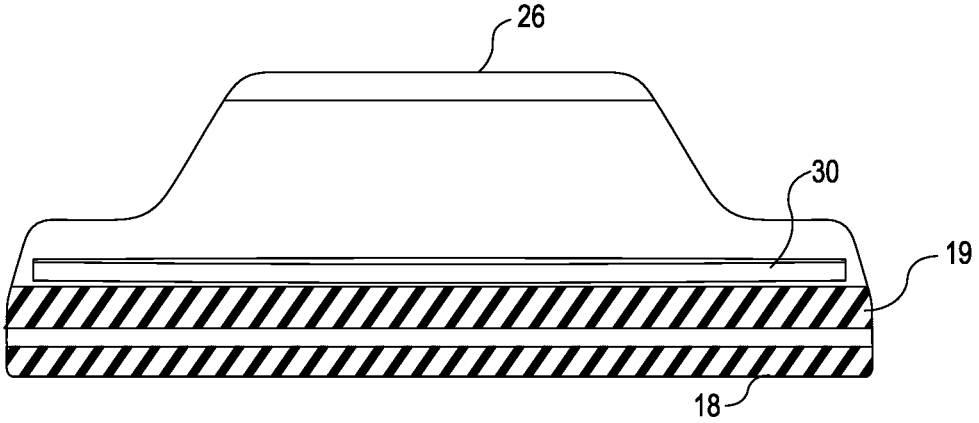
FIG. 5
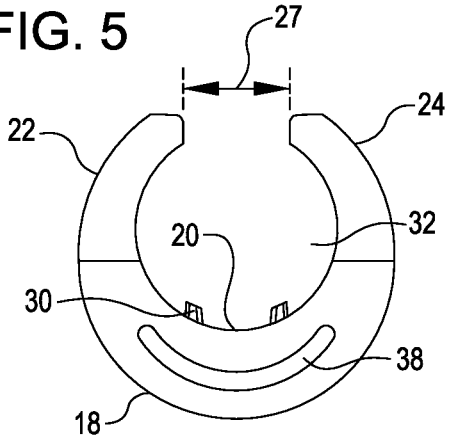

HANDLE WITH PADDLE CLIP

CROSS REFERENCE TO RELATED APPLICATIONS

This application is a U.S. National Phase Application of International Application No. PCT/US2016/038741 filed on Jun. 22, 2016; said application claims priority of and the benefit of U.S. Provisional Application No. 62/182,848, entitled "HANDLE WITH PADDLE CLIP", filed Jun. 22, 2015. The disclosures of International Application No. PCT/US2016/038741 and U.S. Provisional Application No. 62/182,848 are incorporated herein by reference in their entirety.

FIELD OF THE INVENTION

The present disclosure relates to watercraft, and more specifically to a handle for a kayak or canoe which can function as a handle as well as a holder for a paddle or oar.

BACKGROUND

Water sports are popular recreational activities enjoyed by many. Kayaking and canoeing in particular are quite popular. Whether a boater is using an inflatable watercraft or a hard-sided watercraft, there are numerous instances where the boater needs to carry the watercraft to the water, to a vehicle, or over an area of land. Handles connected to watercraft are known. Conventional handles may be rigid or may be made of a webbing material. Similarly, paddle or oar holders are also known which attach the paddle or oar to the watercraft during portage. What is needed is a combination handle and paddle holder to minimize weight and bulk on the watercraft and to minimize materials needed for manufacturing.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In some embodiments, a handle is provided including a base, first and second ends, and first and second sides defining an open channel. The channel has a substantially circular cross section and is contoured to receive and retain a cylindrical paddle shaft with an interference fit.

The handle may further include a slot extending longitudinally through at least a portion of the base, the slot shaped and sized to slidingly accommodate a securing element such as a webbing strap therethrough.

In some embodiments, the handle may include a grip pattern on the base to allow a user to more easily grasp the handle.

The handle may further include drain holes within the body of the handle to allow for drainage of water during use.

For a fuller understanding of the nature and advantages of the present invention, reference should be made to the ensuing detailed description and accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 3 is a perspective view of the handle of FIG. 1, with a securing element shown for reference;

FIG. 4 is a side view of the handle of FIG. 1; and

FIG. 5 is an end view of the handle of FIG. 1.

DETAILED DESCRIPTION

In the following description, various embodiments are described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
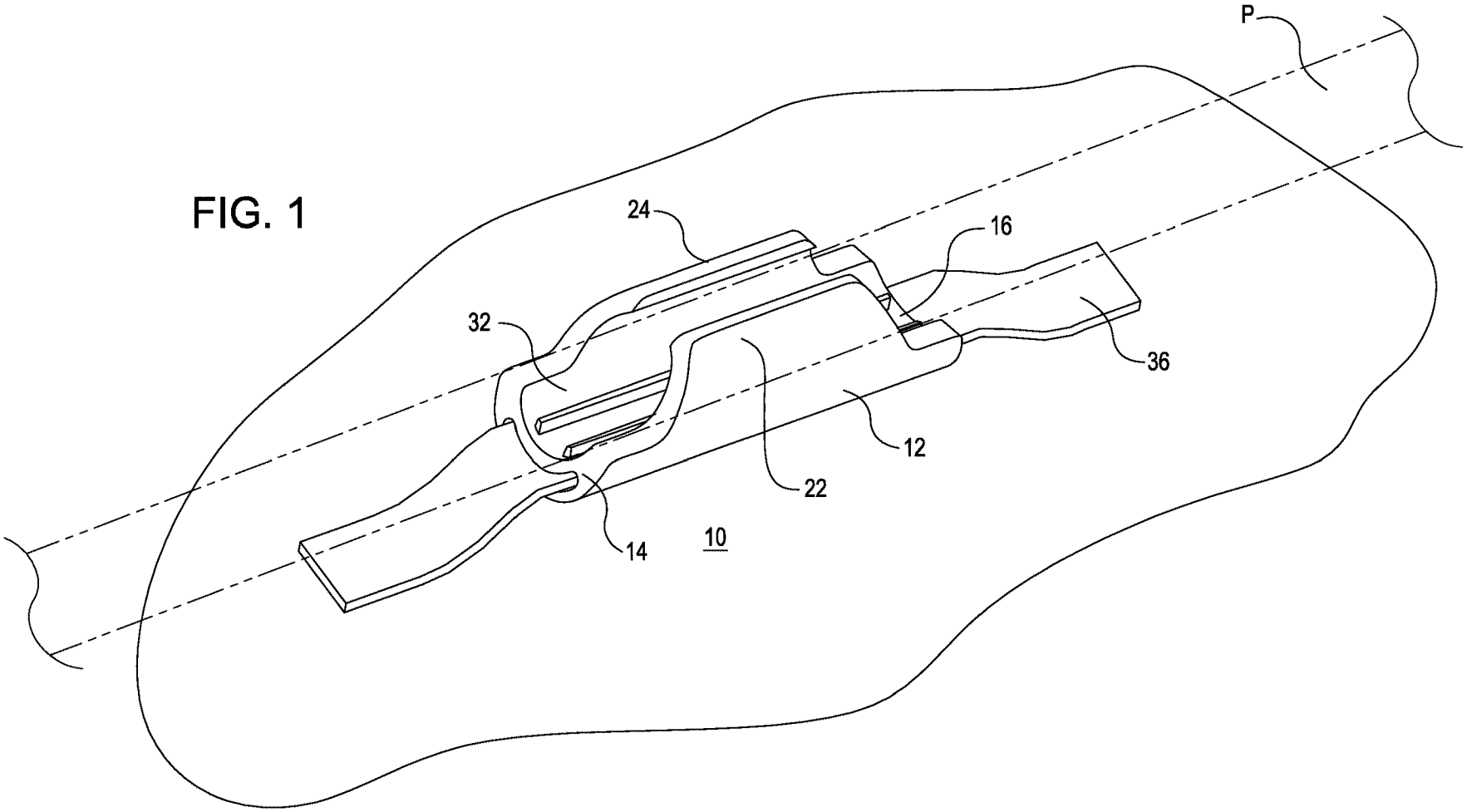
FIG. 1 is a perspective view of a handle of the present invention, shown with a paddle shaft retained therein for reference.
Figure 2:
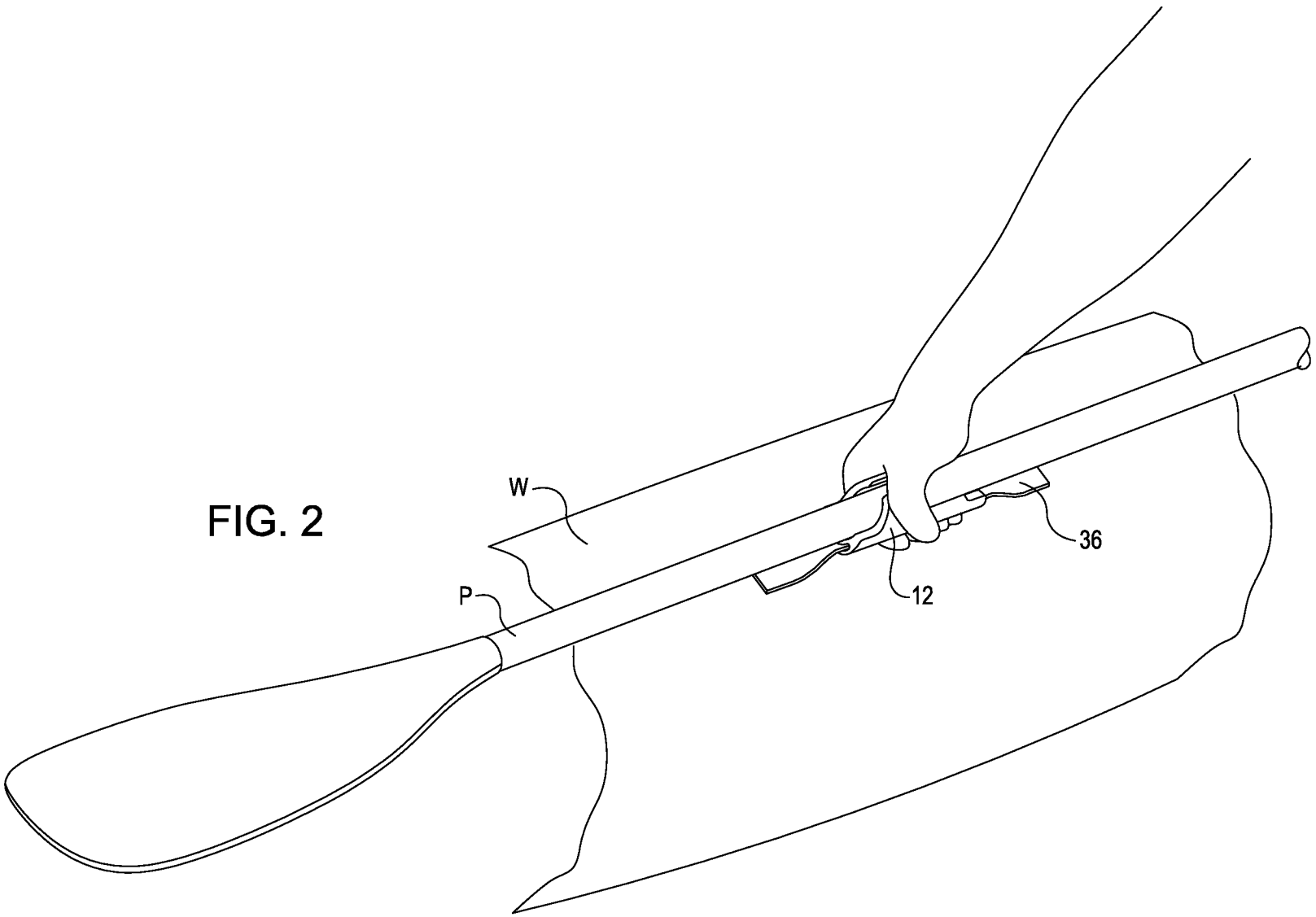
FIG. 2 is a perspective view of the handle shown in FIG. 1, depicted in use as both a handle and a paddle holder.

Referring now to the drawings, in which like reference numerals represent like parts throughout the several views, FIGS. 1 and 2 show the handle assembly 10 of the present invention. Handle assembly 10 includes handle body 12 having opposing ends 14, 16 and opposing contoured sides 22, 24 which define open channel 32 for retaining a paddle shaft P, shown also in FIG. 2. Handle assembly 10 is secured to a surface, preferably a watercraft body W, by securing element 36.

Handle body 12 is preferably substantially circular in cross-sectional shape to fit a user's hand for easy grasping. As shown in FIGS. 1 and 3-5, channel 32 is contoured to fit around a paddle shaft which is cylindrical and the cross sectional shape of channel 32 is preferably substantially circular to easily accommodate a paddle shaft. As shown more clearly in FIGS. 3 and 5, channel 32 is defined by base 19 and first and second contoured sides 22, 24. Channel 32 is open on one side to allow for insertion of a paddle shaft P. Preferably, the open receiving area 27 is the "top side" of handle body 12 which is defined as the side that is directionally opposed to the exterior base surface 18, opens to face interior channel surface 20 and is distanced from the watercraft body W. Receiving area 27 aids in insertion and removal of a paddle or oar from handle body 12. Paddle P is retained in channel 32 via an interference fit. As the paddle P is pushed through open receiving area 27 and into channel 32, first and second sides 22, 24 flex slightly outward to allow passage of paddle P through open receiving area 27. As shown in FIGS. 3 and 5, channel 32 may include one or more longitudinally extending ribs 30 which serve to cushion paddle P and allow for proper drainage and shock absorption. Ribs 30 extend upward from interior channel surface 20.

Securing element 36 passes through slot 38 which extends the length of handle body 12 and is located between exterior base surface 18 and channel base surface 20, within base 19. Slot 38 preferably extends the length of handle body 12 and is substantially parallel to channel 32. It is within the scope of the present invention, however, for slot 38 to extend through only a portion of base 19 and not the entire length. While a single securing element 36 is depicted in the drawings herein and is preferred, it is also within the scope of the invention to have separate securing elements which do not connect to each other and which do not extend the entire length of handle body 12. Securing element 36 is secured to an inflatable watercraft such as a kayak or canoe by either welding or gluing onto the exterior body of the watercraft or by stitching securing element 36 onto an outer fabric covering that surrounds the inflatable body. Handle assembly 10 may also be used with hard-sided watercraft wherein the handle assembly 10 is secured to the exterior body of the watercraft by means known in the industry such as rivets, welding and the like. The general configuration and manufacture of inflatable and hard-sided kayaks and canoes, however, is known, and thus specific configuration details of the watercraft are omitted in order to not obscure the embodiments being described.

Although the drawings show handle body 12 having sides 22, 24 which have a stepped edge 28 towards the ends 14, 16 (FIGS. 3 and 4), it is also within the scope of the present invention for the sides 22, 24 to be substantially the same dimensions the entire length of the body. Optionally, exterior base surface 18 may include a molded grip pattern (not shown) to allow better grasping by the user. Exterior base surface 18 may also include optional drainage apertures (not shown) to allow water to drain out of handle.

Handle body 12 is injection molded from material that is light, strong and flexible such as rubber or a synthetic material such as PVC, polypropylene, acetel, nylon, ABS, or similar materials. Handle body 12 should be sufficiently flexible to receive and retain paddle P securely, yet strong enough to securely retain paddle P, not fatigue and to remain functional after numerous uses in water. Securing element 36 may be made of conventional nylon webbing strap or other durable yet flexible materials which are appropriate for water activities.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A handle system for carrying watercraft, the handle system comprising:

a watercraft;

a base portion attached to the watercraft, the base portion comprising first and second opposing ends; and first and second opposing sides extending from the base portion, wherein a first distance between the first and second opposing ends is greater than a second distance between the first and second opposing sides; wherein the first and second opposing sides define an open channel, the channel having a substantially circular cross section, the channel having an open receiving area extending between top edges of the first and second opposing sides, and the channel contoured to receive and retain a substantially cylindrical item;

wherein the first and second opposing sides and base portion form a handle body to be gripped by a user; and further including a slot extending longitudinally and generally parallel to the channel, the slot extending through at least a portion of said base portion, opposite the open receiving area, wherein the slot is shaped and sized to accommodate a securing element therethrough.

2. The handle system of claim 1 wherein the handle is able to receive and retain a substantially cylindrical item using an interference fit.

3. The handle system of claim 1, further comprising a securing element extending through at least a portion of said slot, said securing element fastening the base portion to the watercraft.

4. A handle system for watercraft portage, the handle system comprising:

a watercraft;

a base portion attached to the watercraft, the base portion comprising first and second opposing ends; and first and second opposing sides extending from the base portion to define an open channel, and wherein a first distance between the first and second opposing ends is greater than a second distance between the first and second opposing sides;

said channel having a substantially circular cross section, the channel having an open receiving area extending between top edges of the first and second opposing sides and being contoured to receive and retain a substantially cylindrical item using an interference fit;

a slot extending longitudinally and generally parallel to the channel, the slot extending through at least a portion of the base portion and being shaped and sized to accommodate a securing element therethrough; and a securing element extending through at least a portion of said slot, said securing element being affixed to the watercraft.

5. A handle system for carrying watercraft, the handle system comprising:

a watercraft;

a base portion comprising first and second opposing ends;

first and second opposing sides extending generally perpendicular to a longitudinal axis of the base portion;

the first and second opposing sides defining an open channel, the channel having a substantially circular cross section, the channel having an open receiving area extending between top edges of the first and second opposing sides, and the channel contoured to receive and retain a substantially cylindrical item;

further including a slot extending longitudinally and generally parallel to the channel, the slot extending through at least a portion of said base portion, opposite the open receiving area, wherein the slot is shaped and sized to accommodate a securing element therethrough; and wherein the first and second opposing sides and base portion form a handle body to be gripped by a user.

* * * * *